US006181888B1

(12) United States Patent
Scheuer et al.

(10) Patent No.: US 6,181,888 B1
(45) Date of Patent: Jan. 30, 2001

(54) APPARATUS AND METHOD FOR SCHEDULING TONER PATCH CREATION FOR IMPLEMENTING DIAGNOSTICS FOR A COLOR IMAGE PROCESSOR'S SYSTEMS PARAMETERS AND SYSTEM FAULT CONDITIONS IN A MANNER THAT MINIMIZES THE WASTE OF TONER MATERIALS WITHOUT COMPROMISING IMAGE QUALITY

(75) Inventors: Mark A. Scheuer, Williamson; Eric M. Gross, Rochester, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/451,722

(22) Filed: Dec. 1, 1999

(51) Int. Cl.[7] ..... G03G 15/00
(52) U.S. Cl. ..... 399/49
(58) Field of Search ..... 399/40, 49, 50, 399/53

(56) References Cited

U.S. PATENT DOCUMENTS

| | | | | |
|---|---|---|---|---|
| 4,377,338 | | 3/1983 | Ernst | 355/14 D |
| 5,144,371 | | 9/1992 | Hays | 355/249 |
| 5,333,037 | | 7/1994 | Inoue et al. | 355/203 |
| 5,339,135 | * | 8/1994 | Scheuer et al. | 399/40 |
| 5,471,313 | | 11/1995 | Thieret et al. | 358/296 |
| 5,600,430 | | 2/1997 | Folkins et al. | 399/171 |
| 5,826,136 | | 10/1998 | Saiko et al. | 399/49 |
| 5,826,139 | | 10/1998 | Nacman et al. | 399/72 |
| 5,839,018 | | 11/1998 | Asanuma et al. | 399/43 |
| 5,862,433 | * | 1/1999 | Regelsberger et al. | 399/53 X |
| 5,923,920 | | 7/1999 | Ishida et al. | 399/46 |
| 5,937,229 | * | 8/1999 | Walgrove et al. | 399/49 X |
| 5,987,271 | * | 11/1999 | Regelsberger et al. | 399/49 X |

* cited by examiner

*Primary Examiner*—Fred L. Braun

(57) ABSTRACT

Apparatus and method for scheduling toner patch creation at a first frequency and monitored for implementing diagnostics for a color image processor's systems parameters and system fault conditions in a manner that minimizes the waste of toner materials without compromising image quality. In the presence of a fault condition the toner patches are created at a different frequency. The number of toner patches required for the control is reduced through the use of complementary color toner patches in lieu of use of color patches for each individual toner colors.

18 Claims, 3 Drawing Sheets

APPARATUS AND METHOD FOR SCHEDULING TONER PATCH CREATION FOR IMPLEMENTING DIAGNOSTICS FOR A COLOR IMAGE PROCESSOR'S SYSTEMS PARAMETERS AND SYSTEM FAULT CONDITIONS IN A MANNER THAT MINIMIZES THE WASTE OF TONER MATERIALS WITHOUT COMPROMISING IMAGE QUALITY

BACKGROUND OF THE INVENTION

This invention relates to color imaging processors and, in particular, to an adaptive toner patch scheduler for implementing diagnostics for the processor's systems parameters and system fault conditions in a manner that minimizes the waste of toner materials without compromising image quality.

The xerographic imaging process is initiated by charging a charge retentive surface such as that of a photoconductive member to a uniform potential, and then exposing a light image of an original document onto the surface of the photoconductor, either directly or via a digital image driven laser. Exposing the charged photoconductor to light selectively discharges areas of the surface while allowing other areas to remain unchanged, thereby creating an electrostatic latent image of the document on the surface of the photoconductive member. A developer material is then brought into contact with the surface of the photoconductor, to transform the latent image into a visible reproduction. The developer typically includes toner particles with an electrical polarity the same as or opposite to the latent images on the photoconductive member. The polarity depends on the image profile. A blank copy sheet is brought into contact with the photoreceptor and the toner particles are transferred thereto by electrostatic charging the sheet. The images on the sheet are subsequently heated, thereby permanently affixing the reproduced image to the sheet. This results in a "hard copy" reproduction of the original document or image. The photoconductive member is then treated including cleaning to remove any charge and/or residual developing material from its surface to prepare it for subsequent imaging cycles.

Electrophotographic printers that operate by projecting a laser scan line onto a photoconductive surface are well known. In printers such as these, it is common to employ a Raster Output Scanner (ROS) as a source of signals to be imaged on the photographic member. The ROS provides a laser beam which switches on and off according to electronic image data associated with the image to be printed as the beam moves, or scans, across the charged photoreceptor. Laser diodes are typically used to generate the laser beam that is used to scan in a ROS system. The image data is driven in serial fashion to reproduce each line in the image. Modulation of the scanning beam is typically implemented by digitally controlling the output of the Light beam or a modulator associated with a continuous laser source. The latent electrostatic images on the photoreceptor may comprise either charged and/or discharged areas of the photoreceptor.

Electrophotographic laser printers, scanners, facsimile machines and similar document reproduction devices, must be able to maintain proper control over the systems of the image producing apparatus to assure high quality, hardcopy outputs. For example, the level of electrostatic charge on the photographic member must be maintained at a certain level to be able to attract the charged toner particles. The light beam must have the proper intensity in order to be able to discharge the photoreceptor. In addition, the toner particles must be at the proper concentration to ensure high print quality. As the printing machine continues to operate, changes in operating conditions will cause these parameters to vary from their initial values. For example, an increase in the humidity in environmental conditions around the corona discharge device used to generate the electrostatic charge on the photoreceptor will cause a decrease in the magnitude of the charge that is ultimately placed on the photoreceptor. Changes due to the variation in operative components of the machine also impact print quality. Thus, it is desirable to monitor the systems operating parameters of the machine to insure proper operation thereof.

One way to control the many parameters within machine that operate together to reproduce images is to use process control patches strategically positioned on the photoconductive or charge-retaining member of the apparatus. The control patches are usually generated by sending a known pattern of data to control the modulation of the light emitting elements in the writing head. Since the data patterns are known, the electrostatic charge that must be present on the surface of the photoreceptor to create it is also known. The control patches are deposited onto a small area of the photoreceptor between areas reserved for placement of the latent images, and the voltage levels across them are measured to provide an indication of their electrostatic charge. Feedback of information derived from the control patches allows for changes in one or more of the operating parameters, thereby enabling substantially constant image quality.

In existing xerographic print engines, sensor readings of toned control patches serve two purposes (1) to provide a basis for adjusting the appropriate system parameters such as corona charging and developer dispense rate to maintain print image quality and (2) to provide a basis for identifying and declaring system fault conditions such as photoreceptor voltage which is too high or too low. In other words, a determination of whether a voltage reading is outside of a target voltage range.

Prior art techniques for accomplishing control of system parameters require a large number of toner patch readings resulting in a significant waste of toner. Thus for system control, there is a strong desire to reduce the number of readings to the minimum required to adequately maintain the system parameters in order to conserve toner. However, the tracking of system fault conditions requires frequent toner patch readings to enable the machine to take corrective actions as soon as possible.

In a full color print engine that incorporates five separate xerographic imaging stations to create process color composite images (cyan, magenta, yellow, black, plus 1 'spot color' for extending the overall color gamut), the control of the Tone Reproduction Curve (TRC) for each station may use a toner coverage sensor such as an Extended Toner Area Coverage Sensor (ETACS) Infrared Densitometer (IRD) to sample three separate halftone patches developed on the photoreceptor in an Interpage Zone (IPZ) between customer images. Thus, the combined system requires a total of 15 separate patches for a five station processor to achieve the same function as a DocuCenter? printer that requires three patches for control of the TRC for black only.

To accommodate the need for extra patches, the above-described print engine uses three ETACS located across the photoreceptor to make fuller use of each separate interpage zone (IPZ). The IPZ length for this machine is enlarged to provide the space needed to rephase (i.e. align them together with each other) the multiple ROSS. This increased length permits three patches to be printed in-line for each ETACS. Both of these increases are limited by architectural constraints and, while quite helpful, still result in a 40% shortfall to the maximum sampling rate.

SUMMARY OF THE INVENTION

Pursuant to the intents and purposes of the present invention, a method and apparatus for implementing diagnostics for a color image processor's systems parameters and system fault conditions in a manner that minimizes the waste of toner materials without compromising image quality is provided.

In a single system using four or more separate imaging stations, it is very unlikely that all systems will require adjustments at the maximum rate. Designing for the worst case situation is wasteful in either parts unit manufacturing cost (by, say, using four or more ETACS) or in toner usage due to frequent patch generation. However, if any given station is so variable as to need the maximum possible sampling rate then it must be sampled at that rate to identify a fault condition.

To accommodate the need for both infrequent run time control patches for maintaining print quality and frequent diagnostics patches for identifying overall problems (machine fault conditions), a new type of control patch is utilized, i.e. a set of composite diagnostic patches (i.e. patches created using two toners) for the complementary colorants. For example, when a set of yellow control patches is being written and measured in the IPZ for maintaining image quality, the system will generate a set of three patches (five station image processor) consisting of a yellow patch and combination patch of the complementary colorants such as blue (magenta and cyan toners) and a dark spot patch consisting of the spot color and black. The ETACS readings of these combination patches will not be used to adjust the image quality of the system. Instead, they will be used to identify possible problems with the associated process stations in order to schedule more frequent single colorant patches in IPZs for runtime control adjustments.

One possible scenario is:

When writing and controlling: Also write (for diagnostics):

| | | |
|---|---|---|
| Yellow | Blue (magenta + cyan) | and Dark Spot (Black + Spot) |
| Magenta | Green (cyan + yellow) | and Dark Spot (Black + Spot) |
| Cyan | Red (magenta + yellow) | and Dark Spot (Black + Spot) |
| Black | Green (cyan + yellow) | and Reddish Spot (magenta + Spot) |
| Spot | Blue (cyan + magenta) | and Dark Yellow (yellow + Black) |

Thus, when a set of three yellow patches is written for process control a single blue patch and a single dark spot patch are also written for diagnostics for fault determination and so on. It will be appreciated that other combinations are also possible.

If the blue patch reading is too far from target, both magenta and cyan control patches will be scheduled as soon as possible for restoring the image quality.

By combining the remaining colorants into two sets of composite patches, the overall system can sample five stations in a single IPZ and can identify problems at the same sampling rate as the single black-only.

The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,377,338 granted Larry M. Ernst to on Mar. 22, 1983 discloses a device wherein data correlated to the light reflectance of a maximum toned area and a minimum toned area is recorded to establish standards for monitoring and controlling subsequent copier operation. A test pattern is imaged onto the photoconductor by controlled illumination levels in a series of steps with the detection of light reflectance from that test pattern being subsequently compared to establish the maximum black and maximum white criteria for storage. Light reflected from cleaned photoconductor areas and subsequently established toner patches then are used to compare against the original test pattern reflectance data. Toner replenishment, controls and machine function monitoring (e.g.: white copy background, developer operation, etc.) are based on these recorded standards from the test pattern.

U.S. Pat. No. 5,333,037 granted to Inoue et al on Jul. 26, 1994 discloses an image-quality stabilizer for an Electrophotographic apparatus forms a toner patch on a photoreceptor drum, detects the amount of toner attracted to the photoreceptor drum by an optical sensor, and controls each processing device so that the detected value is equal to a reference value which has been detected and stored when the number of image forming operations performed is low. After the control, the toner patch is transferred to a transfer sheet, and the amount of toner remaining on the photoreceptor drum is detected. The reference value is adjusted based on the detected value so as to compensate for a lowering of transfer efficiency. Or the lowering of transfer efficiency is compensated by controlling variables such as transfer output so that the detected value is equal to a reference residual value which has been detected and stored when the number of image forming operations performed is low. This arrangement restrains a lowering of image density due to a change in the transfer efficiency. It is therefore possible to control stabilizing the image quality accurately and to form images of stable quality.

U.S. Pat. No. 5,826,136 granted to Saiko et al on Oct. 20, 1998 discloses an image stabilizing method for use in an image forming apparatus, comprising the steps of: creating toner patches on the surface of the photoreceptor; detecting the density of the toner patches; correcting the charger output in accordance with the density of toner patches detected; and implementing process control for correcting the toner concentration in the developing unit if the correcting amount of the charger output excesses a predetermined value, wherein if the toner concentration is corrected at the current process control, a concentration stabilizing treatment for stabilizing the image density is implemented before the start of the next process control.

U.S. Pat. No. 5,839,018 granted to Asanuma et al on Nov. 17, 1998 discloses an image forming apparatus which controls the toner density by any one of the following configurations: by correcting the toner density of the developer in association with the agitation total; by controlling a process parameter so that the density of a toner patch formed on the photoreceptor corresponds to a prescribed density value and determining that developing performance of the developer is improved and canceling the toner density correction when the process parameter reaches the prescribed value; by changing the toner density reference value when the variation as to the charger output is equal to or greater than a first predetermined value and maintaining the changed toner density reference value until the variation of the charger output again becomes equal to or greater than the first predetermined value; or by prohibiting toner supply for a constant duration to prevent excessive toner supply if time from the end of the last operation of the developing unit to the start of a next operation, inclusive of the power-activation is equal to or longer the a predetermined period when the developing unit is activated to commence agitation of the developer.

U.S. Pat. No. 5,923,920 granted to Ishida et al on Jul. 13, 1999 discloses an image forming apparatus has an arrangement wherein a main charger includes a charger line corresponding to a region within a reference range on a surface of a photoreceptor and second charger lines corresponding to regions outside the reference range, and the first charger line within the reference range and the second charger lines outside the reference range are driven independently. The reference range is set on the surface of the photoreceptor as a width of a transported sheet which is most frequently used. In a processing control, in the case where toner patch density within the reference range becomes higher than toner patch density outside the reference range, an applied voltage with respect to the charger line within the reference range is increased relatively higher than an applied voltage with respect to the charger lines outside the reference range, thus uniformalizing the toner density with respect to the entire surface of the photoreceptor drum.

U.S. Pat. No. 5,826,139 granted to Nacman et al on Oct. 20, 1998 discloses a method and apparatus for reproducing high quality images using an electrophotographic printing machine is disclosed. More specifically, the present invention is used to change the location, shape and size of a process control patch. Process control patches may be used to improve the quality of an image prior to printing. The intensity of light reflected from the control patch is measured, and the measurements are used to change parameters such as magnitude of electrostatic charge, and toner concentration, before the latent image is developed. Adjusting these parameters at this time will allow the printing apparatus to reproduce images having superior quality than previously available.

DETAILED DESCRIPTION OF THE DRAWINGS

DESCRIPTION OF THE PREFERRED EMBODIMENT

Figure 1:
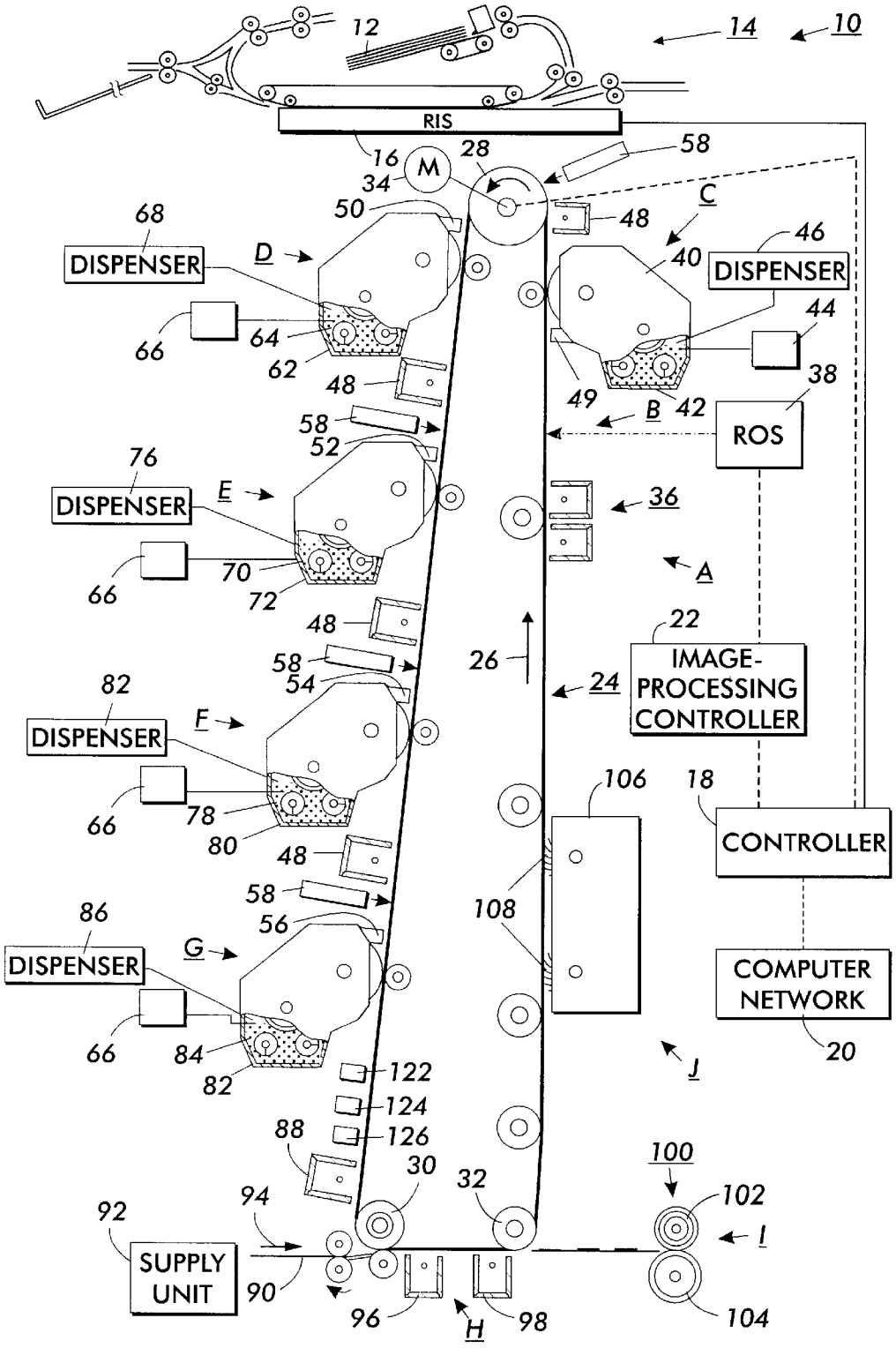
FIG. 1 is a schematic illustration of a xerographic print engine in which the present invention may be utilized.

In one embodiment of the invention, an original document 12 can be positioned in a document handler 14 on a Raster Input Scanner (RIS) indicated generally by reference numeral 16. However, other types of scanners may be substituted for RIS 16. The RIS 16 captures the entire original document and converts it to a series of raster scan lines or image signals. This information is transmitted to an electronic subsystem (ESS) or controller 18. Alternatively, image signals may be supplied by a computer network 20 to controller 18. An image-processing controller 22 receives the document information from the controller 18 and converts this document information into electrical signals for use by a raster output scanner.

The printing machine preferably uses a charge retentive surface in the form of a photoreceptor belt 24 supported for movement in the direction indicated by arrow 26, for advancing sequentially through various xerographic process stations. The photoreceptor belt 24 is entrained about a drive roller 28, tension roller 30, fixed roller 32. The drive roller 28 is operatively connected to a drive motor 34 for effecting movement of the photoreceptor belt 24 through the xerographic stations. In operation, as the photoreceptor belt 24 passes through charging station A, a corona generating arrangement, indicated generally by the reference numeral 36, charges the photoconductive surface of photoreceptor belt 24 to a relatively high, substantially uniform, preferably potential. The corona discharge arrangement preferably comprises an AC scorotron and a DC dichorotron having grid elements to which suitable voltages are applied. Target values for these voltages dependent on a particular machine requirement are stored in Non Volatile Memory (NVM).

Next, photoconductive surface 24 is advanced through an imaging/exposure station B. As the photoreceptor passes through the imaging/exposure station B, the controller 18 receives image signals representing the desired output image from Raster Input Scanner 16 or computer network 20 and processes these signals to convert them to the various color separations of the image. The desired output image is transmitted to a laser based output scanning device, which causes the uniformly charged surface of the photoreceptor belt 24 to be discharged in accordance with the output from the scanning device. Preferably the laser based scanning device is a laser Raster Output Scanner (ROS) 38. Alternatively, the ROS 38 could be replaced by other xerographic exposure devices such as an LED array.

The photoreceptor belt 24, which is initially charged to a voltage V0, undergoes dark decay to a level equal to about −500 volts. When exposed at the exposure station B, it is discharged to a residual voltage level equal to about −50 volts. Thus after exposure, the photoreceptor belt 24 contains a monopolar voltage profile of high and low voltages, the former corresponding to charged areas and the latter corresponding to discharged or background areas. The high voltage portions of the photoreceptor are developed using Charged Area Development while the low voltage portions are developed using Discharged Area Development.

At a first development station C where a first separation image is developed a first development station C comprising any type of development system even a magnetic brush development system may be used. Preferably a hybrid scavengeless development system including a developer structure 40 is utilized. A hybrid scavengeless development system provides the ability to develop downstream toners without scavenging toners already placed on the photoreceptor by the development of upstream image separations. As will be appreciated, the use of a scavengeless development system at the first development station is not necessary because it doesn't interact with an already developed image as do subsequent development structures.

Hybrid scavengeless development systems are used in development stations subsequent to station C because other developer system would interact with a previously developed. A hybrid scavengeless development system utilizes a standard magnetic brush development system to place charged toner on two donor rolls. A set of wires is located between the donor rolls and the photoreceptor. AC and DC fields are established on the donor and wires to create a powder cloud of toner near the photoreceptor. The frequency of the AC is set to prevent toner in the cloud from touching the photoreceptor. Instead, the image fields on the photoreceptor reach into the powder cloud and attract the toner out of the cloud. This arrangement is highly successful in preventing scavenging of developed toner images. For a more detailed description of a scavengeless development system, reference may be had to U.S. Pat. No. 5,144,371 granted to Dan Hays on Sep. 1, 1992.

The developer structure 40 contains, for example, magenta toner particles 42. The powder cloud causes charged magenta toner particles 42 to be attracted to the electrostatic latent image. Appropriate developer biasing is accomplished via a power supply (not shown). This type of development system is a hybrid scavengless type in which only toner particles (magenta, for example) are attracted to the latent image and there is no mechanical contact between the photoreceptor belt 24 and the toner delivery device which would disturb a previously developed, but unfixed, image. A toner concentration sensor 44 senses the toner concentration in the developer structure 40. A dispenser 46 dispenses magenta toner into the developer structure 40 to maintain a proper toner concentration. The dispenser 46 is controlled via controller 18.

The developed but unfixed or non-fused image is then transported past a second charging device 48 where the photoreceptor belt 24 carrying the previously developed magenta toner image areas is recharged to a predetermined level. The charging device 48 comprises a split recharge system, wherein both a direct and an alternating current charging device, are used. While disclosed in the drawing as a single member the split charge arrangement actually comprises separate components for effecting the DC and AC functionality. Split recharging ensures uniform charge areas on the photoreceptor, independent of previously developed toner images. The split recharge system requires that the electrostatic controls for each separation be maintained within the confines of the charge, expose, and develop steps within the image separations. For a more detailed description of a split recharge system, reference may be had to U.S. Pat. No. 5,600,430 granted on Feb. 4, 1997 to Folkins et al.

Five separate ESVs, 49, 50, 52, 54 and 56 are employed for monitoring exposure voltages. There is one ESV for each development housing structure. Each ESV is mounted on the upstream end of the developer housing structure with which it is associated such that they sense photoreceptor voltage prior to image development. The ESVs monitor the exposed voltages but do not directly control them. The ESV 49 is mounted on one end of the developer housing structure 40 in a position that is intermediate the ROS 38 and a developer roll forming a part of that housing structure.

A second exposure/imaging is performed by a device 58 preferably comprising a laser based output structure. The device 58 is utilized for selectively discharging the photoreceptor belt 24 on toned and/or untoned image areas of the photoreceptor 24, in accordance with the image information being processed. Device 58 may be a Raster Output Scanner or LED bar, which is controlled by controller 18 or network computer 20. At this point, the photoreceptor belt 24 may contain toned and untoned image areas at relatively high voltage levels and toned and untoned areas at relatively low voltage levels. Low voltage areas represent image areas that will be developed using Discharged Area Development (DAD) while high voltage areas are areas that will remain untoned. A suitably charged, developer material comprising the second color toner 64, preferably yellow, is employed. The second color toner is contained in a developer structure 62 disposed at a second developer station D and is presented to the latent electrostatic images on the photoreceptor belt 24 by way of a second developer system. A power supply (not shown) serves to electrically bias the developer structure 62 to a level effective to develop the appropriate image areas with charged yellow toner particles 64. Further, a toner concentration sensor 66 senses the toner concentration in the developer structure 62. A toner dispenser 68 dispenses yellow toner into the developer structure 62 to maintain a proper toner concentration. The dispenser 68 is controlled via controller 18.

The above procedure is repeated for a third image for a third suitable color toner such as cyan 70 contained in developer structure 72 (station E), and for a fourth image and suitable color toner such as black 78 contained in a developer structure (station F). Toner dispensers 76 and 82 serve to replenish their respective development systems.

A fifth imaging station G is provided with a developer structure 82 containing a spot toner 84 of any suitable color for use in extending the color gamut of this image processor. Toner replenishment is effected using a toner dispenser 86. Preferably, developer systems 42, 62, 72, 80 and 82 are the same or similar in structure. Also, preferably, the dispensers 44, 68, 76, 82 and 86 are the same or similar in structure.

Each of the ESVs 50, 52, 54 and 56 is positioned intermediate the ROS and the developer roll of the developer housing structure with which it is associated, as shown at the development stations.

The composite image developed on the photoreceptor belt 24 consists of both high and low charged toner particles, therefore a pre-transfer corona discharge member 88 is provided to condition all of the toner to the proper charge level for effective transfer to a substrate 90 using a corona discharge device exhibiting a predetermined discharge of the desired polarity.

Subsequent to image development, a sheet of support material 90 is moved into contact with the toner images at transfer station H. The sheet of substrate material 90 is advanced to transfer station H from a supply unit 92 in the direction of arrow 94. The sheet of support material 90 is then brought into contact with photoconductive surface of photoreceptor belt 24 in a timed sequence so that the toner powder image developed thereon contacts the advancing sheet of support material 90 at transfer station H.

Transfer station H includes a transfer corona discharge device 96 for spraying ions onto the backside of support material 90. The polarity of these ions is opposite to the polarity of that exhibited by the pretransfer corona discharge device 88. Thus, the charged toner powder particles forming the developed images on the photoreceptor belt 24 are attracted to sheet 90. A detack dichorotron 98 is provided for facilitating stripping of the sheets from the photoreceptor belt 24 as the belt moves over the roller 32.

After transfer, the sheet of support material 90 continues to move onto a conveyor (not shown) which advances the sheet to fusing station I. Fusing station I includes a heat and pressure fuser assembly, indicated generally by the reference numeral 100, which permanently affixes the transferred powder image to sheet 90. Preferably, fuser assembly 100 comprises a heated fuser roller 102 and a backup or pressure roller 104. Sheet 90 passes between fuser roller 102 and backup roller 104 with the toner powder images contacting fuser roller 102. In this manner, the toner powder images are permanently affixed to sheet 90. After fusing, a chute, not shown, guides the advancing sheets 90 to a catch tray, stacker, finisher or other output device (not shown), for subsequent removal from the printing machine by the operator.

After the sheet of support material 90 is separated from photoconductive surface of photoreceptor belt 24, the residual toner particles remaining on the photoconductive surface after transfer are removed therefrom. These particles are removed at cleaning station using a cleaning brush or plural brush structure contained in a cleaner housing structure 106. The cleaner housing structure contains a plurality of brushes 108 which contact the photoreceptor for removal of residual toner therefrom after the toner images have been transferred to a sheet or substrate 90.

Controller 18 regulates the various printer functions. The controller 18 preferably includes one or more programmable controllers, which control printer functions hereinbefore described. The controller 18 may also provide a comparison count of the copy sheets, the number of documents being recirculated, the number of copy sheets selected by the operator, time delays, jam corrections, etc. The control of many of the xerographic systems heretofore described may be accomplished automatically or through the use of a user interface of the printing machine consoles selected by an operator. Conventional sheet path sensors or switches may be utilized to keep track of the position of the document and the copy sheets.

Figure 2:
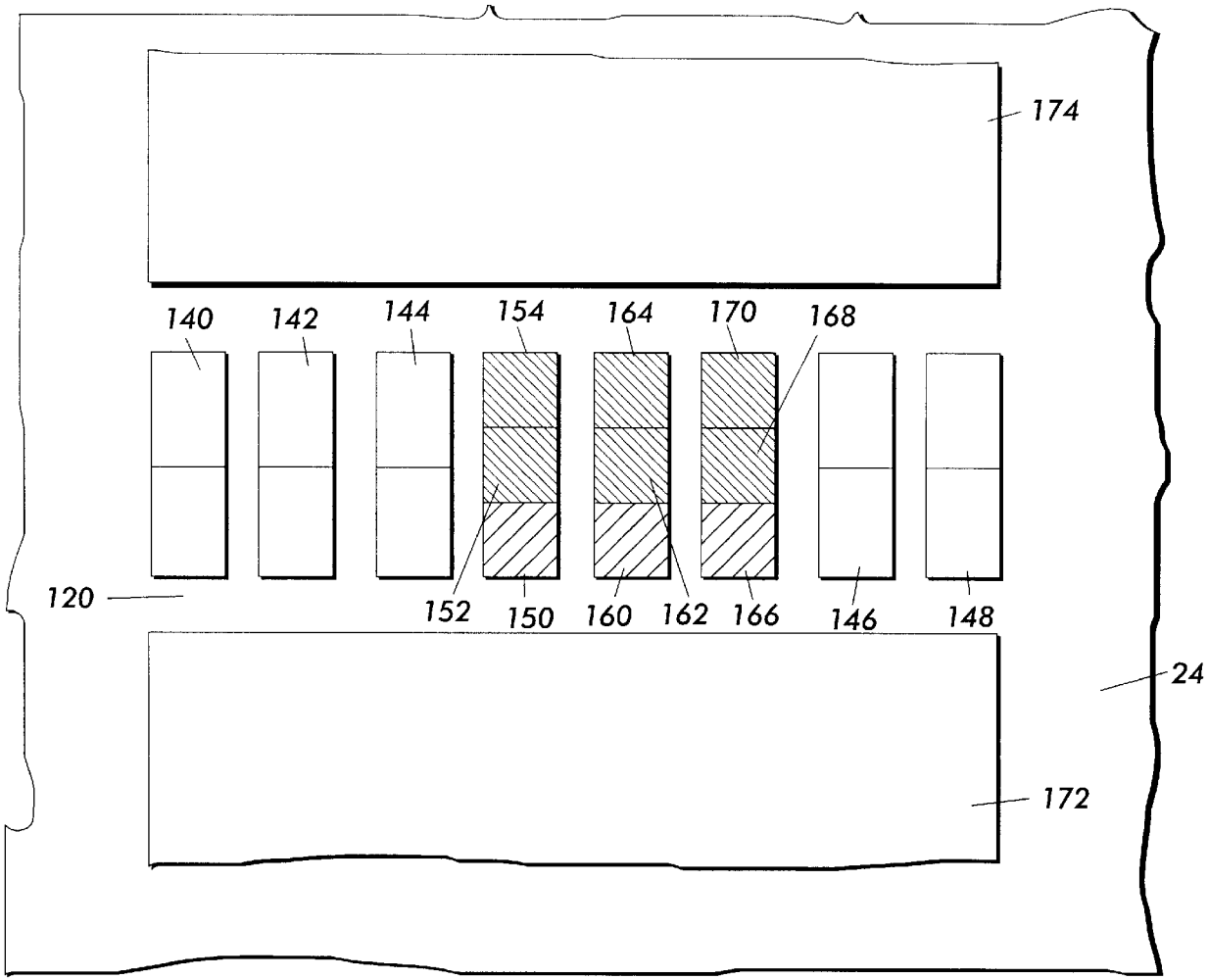
FIG. 2 is a partial plan view of a photoreceptor illustrating an InterPage Zone (IPZ) containing a plurality of toned and untoned test patches positioned in an IPZ.

As is the case in of all print engines of the type disclosed, the photoreceptor 24 contains a plurality of Interpage Zone (IPZ) frames 120 (FIG. 2). IPZ refers to the space between successive toner powder images formed on the photoreceptor 24. Each IPZ contains patches to be read by the five ESVs 49, 50, 52, 54 and 56 and three ETACS 122, 124 and 126. The ETACS are positioned downstream of the last developer structure 82 and upstream of the pretransfer corona device 88.

Figure 3:
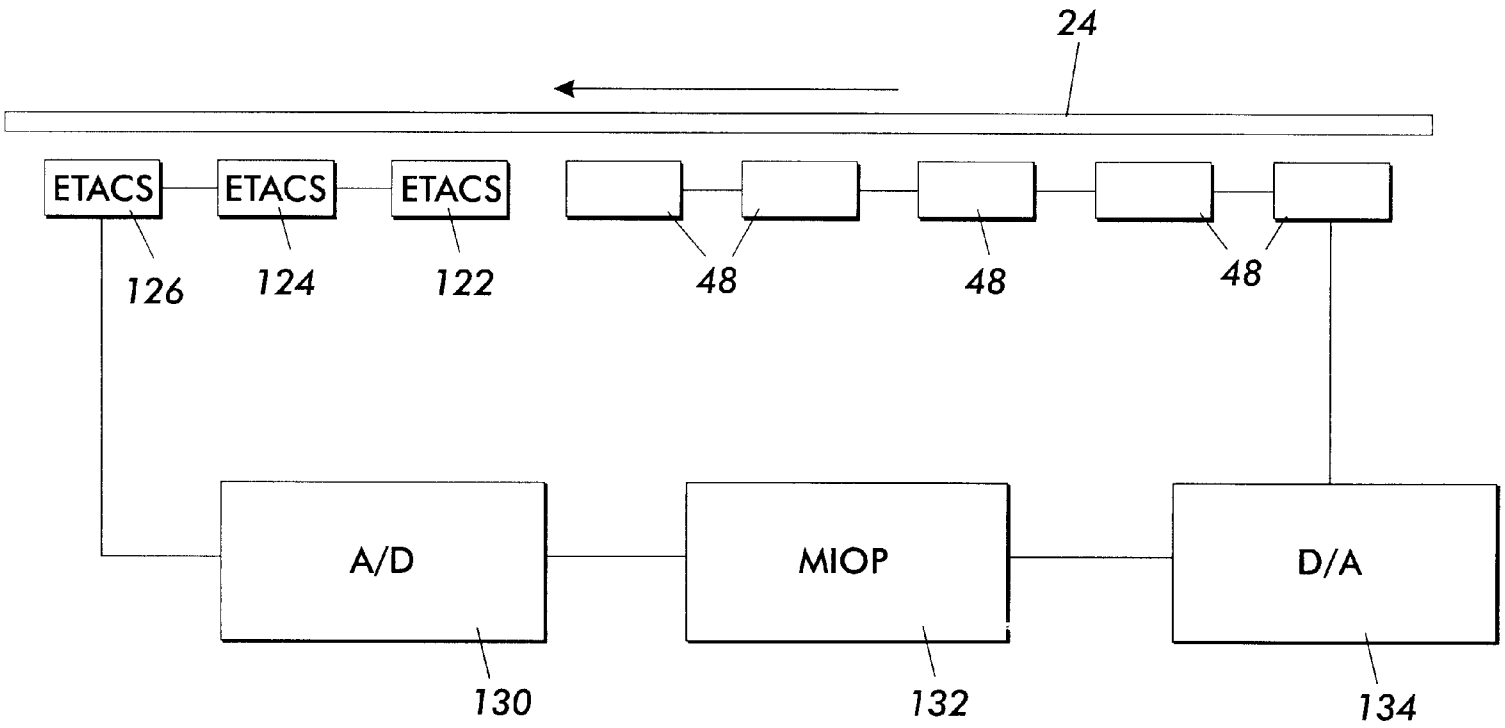
FIG. 3 is a schematic diagram of an adaptive toner patch scheduling control according to the present invention.

Readings made by the ETACS are converted, using an Analog to Digital (A/D) converter 130, to digital information for use through software algorithms resident in a Master Input Output Processor or controller, MIOP 132 (see FIG. 3). Outputs from the MIOP are converted to analog signal information via a Digital to Analog (D/A) converter 134 for use in controlling, by way of example, the corona discharge devices 36 and 48. The needed range of charge potentials on the photoreceptor is approximately 0–1300 volts output for a 0 to 5 volts analog input to the scorotron and dichorotron power supplies. A 10 bit D/A will give about 1.25 volt/step resolution. Suitable target values are stored in Non Volatile Memory forming a part of the MIOP. The electrostatic control algorithm will consist of a proportional-integral feedback loop with anti-windup that adjusts the AC scorotron grid voltage based on the measured error between the ESV readings and the charge target provided by the level 2 developability and dot gain controller.

The DC dicorotron grid voltage is set using the AC scorotron grid voltage plus a split voltage between the two grids. The split voltage is established during a setup routine where the actual voltage on the photoreceptor is measured using each device separately. A desired split voltage on the photoreceptor is an NVM value and the difference between the two grid voltages is set to achieve this target.

A set of inner and outer limits is defined around the charge target. Readings inside the inner limit are used to declare the charge controls "converged," allowing subsequent level 2 ETACS readings to be acquired. Failure to converge charge within a fixed number of attempts will result in a system fault.

Readings outside the outer limits will be used to suspend the customer's job and send the print engine into a dead cycle mode to converge charge as quickly as possible. Exceeding the outer limit when the AC scorotron grid is at its operational limit will result in a system fault.

The use of a hierarchical control strategy isolates subsystem controls thereby enabling efficient algorithm design analysis and implementation for the algorithms forming a part of the MIOP. It will be appreciated that while only the controller for the corona charging devices has been described, other controllers are utilized for Level 1 subsystems. Other Level 1 controllers may include any or all of the following controllers: a charging controller, a laser power controller, a toner concentration controller, a transfer efficiency controller, a fuser temperature controller, a cleaning controller, a decurler controller and a fuser stripper controller.

To control the marking engine of a particular IOT to maintain a desired TRC, the hierarchical controls strategy of the architecture of the disclosed machine is divided into two additional levels of controllers, Level 2 and Level 3. Each of the controllers in the three levels comprises a sensor, a controller algorithm and an actuator which adjusts the process being controlled by the controller in response to a sensed parameter. The Level 1 controllers stabilize the individual process steps of forming an image locally by using data output from a single sensor provided for each Level 1 subsystem and directly adjusting an actuator for each of the Level 1 subsystems. Level 2 controllers provide regional rather than local control of intermediate process outputs. Level 2 controllers receive a set of scalar values from the Level 1 controllers in addition to sensor readings of the intermediate process output being controlled. Actuation in Level 2 occurs on an algorithm parameter of a Level 1 controller (usually a setpoint). That is, Level 2 actuates or adjusts based on a sensor output by changing at least one parameter for at least one Level 1 controller. Levels 1 and 2 adjust the physical components and processes involved in outputting an image in order to achieve TRC stabilization at a small number of discrete points. In between these points on the TRC, stabilization is achieved by the Level 3 controller which measures the output of the total system and adjusts the interpretation of the image at the input to the process.

Each frame or IPZ contains two untoned or undeveloped patch areas for use with each of the five ESVs and three toned or developed patch areas for use with each of the three ETACS for a total of nineteen patches. The untoned and undeveloped ESV patches consist of two patches 140 black for black, two patches 142 for cyan, two patches 144 for yellow, two patches 146 for magenta and two patches 148 for the spot color.

By way of example, toned patches to be sensed by the ETACS may comprise one set of three patches comprising a toned patch 150 consisting of only yellow toner and two toned complementary patches 152 and 154 consisting of a blue (magenta plus cyan) patch and dark spot (black plus spot) patch, respectively. A second set of three toned patches may comprise a patch 160 consisting of magenta toner and a pair of toned complementary patches comprising a green (cyan plus yellow) patch 162 and a dark spot (black plus spot) patch 164. The third set of three patches may comprise a patch 166 consisting of cyan toner and a pair of complementary patches comprising a red (magenta plus yellow) patch 168 and a dark spot (black plus spot) patch 170. The patches are disposed in IPZs 120 intermediate full color image areas 172 and 174.

The content of the separate patch areas, illustrated in FIG. 2, by way of example, will change in successive IPZs, according to a runtime patch scheduler algorithm forming a part of the MIOP. The placement of the patches within each IPZ remains fixed following autosetup of the imaging processor. ESV operation does not form a part of this invention, therefore, no further discussion thereof is deemed necessary.

Each IPZ frame is approximately 43 mm long, which is the distance required by each ROS to allow ample time for aligning the images in each xerographic module to each other (using a process referred to as rephasing). The ROS rephase process is not expected to affect the control patch image structure on a scale comparable to the ETACS or ESV field of view. The number of IPZs on the photoreceptor belt structure 24 is a function of the number of images that are be placed on the belt during one pass of the belt through all of the process stations. The number of IPZs varies from machine to machine.

The position and size of each patch in the IPZ will be established by a diagnostic timing routine during autosetup. The patches for each sensor are placed according to the field of view of each sensor, determined by the physical mounting dimensions for each sensor as well as internal dimensions for the sensing elements within each sensor. This process allows for minimum control patch sizes and, correspondingly, minimal toner waste. The ETACS patches are approximately 10 mm wide by 13 mm long (130 mm2) and the ESV patches are no wider than 12 mm wide by 19 mm long (228 mm2). In contrast, current xerographic systems use control patches of 25 mm wide and 25 mm long (625 mm2).

Heretofore, copiers and printers utilized a fixed patch schedule to satisfy the needs for both process controls updates and diagnostics. When the system is well behaved and slowly varying, the need for control updates occurs less frequently. For these systems the need for diagnostics to be able to shut down the system quickly when a sudden failure occurs is critical. However, the cost of the patches is expensive in both the cost toner utilized and the loss of available space to close either level 2 (a hierarchical controls strategy for coarse control of the tone reproduction curve to establish solid area developability and dot gain) or level 3 (a hierarchical controls strategy for fine control of the Tone Reproduction Curve, TRC after level 2 is "closed") for a different separation.

A hierarchical control strategy is one, which isolates subsystem controls for purposes of efficient algorithm design, analysis and implementation. The strategy and architecture support therefor is preferably divided into three levels (i.e. 1, 2 and 3 ) and has a controls supervisor that provides subsystem isolation functions and reliability assurance functions. The strategy improves image quality of an Image Output Terminal, IOT outputs by controlling the operation of the IOT to ensure that a toner reproduction curve of an output image matches a tone reproduction curve of an input image, despite several uncontrollable variables which change the tone reproduction curve of the output image.

The xerographic process controls system for present invention is designed to maintain the image quality of solids, background, and halftones for each separation (CMYK) in a single pass ReaD (Recharge, Expose, and Develop) IOI (image-on-image) full process color DOT. The process controls system consists of a completely integrated hierarchy system with, level 1 electrostatics and toner concentration control, level 2 solid area developability and dot gain control, and level 3 TRC adjustment, control functions.

The hierarchy of control functions, from the top down, are:

1. A default internal definition of the desired tone reproduction curve for each color image separation (cyan, magenta, yellow, and black). The source of target TRCs is out of scope for the process controls function. Presumably they are based on the implied TRCs contained within a Color Rendition Dictionary utilized by the Digital Front End to process the input digital image.

This TRC is independent of the customer adjustable TRCs attached to the post script document on a page-by-page basis via soft loadable TRCs in the image path.

2. Level 3 Tone Reproduction Curve fine control is accomplished via feedback from ETAC sensors reading a set of cyan, magenta, yellow and black halftone image patches in the interpage zones (IPZs) between customer images. A halftone imaging lookup table (LUT) stored in Non-Volatile Memory (NVM) for each separation in the real-time image path is used to maintain the associated output TRC.

The TRCs for image-on-image colors formed by combinations of CMYK separations will be an outcome of the image-on-image xerographic process and will not be directly controlled by the process controls function.

3. Level 2 solid area developability and dot gain control will also be accomplished via feedback control from ETAC sensors reading image patches in the interpage zones between customer images. The controller will maintain both solid area development and dot size for each separation by adjusting the magnitude of the development and cleaning fields and their position on the photo-induced discharge curve of the photoreceptor.
4. Level 1 toner concentration control will be accomplished using a combination of feed forward contone byte counting from the image path and feedback from an in-housing toner concentration sensor that measures magnetic permeability of the developer material.
5. Level 1 electrostatic control will be accomplished via feedback control from an electrostatic voltmeter (ESV) located between the ROS and the developer housing in each xerographic module. Control algorithms will adjust the photoreceptor charge via voltage changes to the AC scorotron grid.

In this architecture, each level will have its own set of feed forward and feedback algorithms involving sensor readings and unique actuators such as scorotron grid voltages. A higher level interacts with the lower levels only by adjusting the control targets of the lower levels. They never interfere with the control mechanics of the lower levels, as this might lead to instabilities. Level interaction is illustrated in the flow diagrams below. Where, by way of example, n corresponds to Level 1 and n+1 corresponds to Level 2.

To accomplish this there is an implicit assumption about various time scales associated with the behavior of this machine's xerographic process. Features on the lower levels must converge faster than those on the higher levels and processes maintained on the higher levels must vary slower than those on the lower levels. For a more detailed description of a hierarchical control strategy, reference may be had to U.S. Pat. No. 5,471,313, granted to Tracy E. Thieret et al on Nov. 28, 1995 and incorporated herein by reference.

The print image creation machine of the present invention uses an adaptive patch scheduler to minimize the number of patches used for process controls and thereby minimize toner waste. As the magnitude of the actuator changes is reduced, the minimum number of machine clocks between updates will increase. If the magnitude of the actuator changes increases, the minimum number of machine clocks between updates will be decreased. In other words, if a process actuator is operating within its target values the frequency of patch generation for that process is decreased. Conversely, if that actuator is not operating within its target values then the frequency of patch generation is increased. An example of an actuator is corona discharge device.

With adaptive patch scheduling, patches of a particular color may not be checked with sufficient frequency to detect faults timely. Between control readings, additional composite patches will be scheduled and read. As long as the readings are properly bounded (i.e. within upper and lower voltage targets), the system will continue to operate normally. Readings outside the pre-established bounds will cause a contributing development system to be quickly checked (by scheduling a set of level 2 readings). If the electrostatics are not in bounds (but inside the outer limits), some deadcycling may be used to avoid printing the customer's job until the situation is checked.

To handle the need for diagnostics, the system schedules composite patches—red, green, blue, and/or process black—for the ETACS to read. These patches will be loosely range checked, since diagnostics does not need precise readings. If the readings fall outside an acceptable range, the system will quickly schedule a level 2 update for each separation to isolate and correct the problem.

If the ETACS readings fall outside the outer limit around the control targets, the system will enter a dead cycle mode. Patches can then be scheduled within those areas of the photoreceptor used for customer prints, thereby allowing a large number of samples to be measured quickly. In this mode there is no need to step the actuator changes because prints are not being made. The level 1 electrostatics must still converge between level 2 updates. The minimum wait between updates is suspended.

Dead cycling can also occur if the backlog of ETACS readings becomes too large. With only 3 ETACS and four or five separations vying for readings for both level 2 and level 3 updates, the system may not be able to keep up with all the requests of the scheduler. A brief period of dead cycling will allow the system to quickly eliminate the backlog.

Pursuant to the present invention, the need to accommodate both infrequent run time control patches for maintaining print quality and frequent diagnostics patches for identifying overall problems (machine fault conditions), is satisfied by the utilization of a new type of control i.e., a set of composite diagnostic patches (i.e. patches created using two toners) for the complementary colorants. The use of complementary colorant patches for fault detection allows for infrequent generation of run time control patches thereby resulting in saving a significant amount of toner.

In operation, once a fault is detected via an ETACS reading of one of the complementary toner patches, the adaptive patch scheduling system of the present invention increases the frequency of generation of one or more of the patches used in conjunction with a process parameter exhibiting the fault. For example, the frequency of a patch consisting of black toner may be increased when a fault is detected with respect to the black process station. Thus, the black patch that is normally scheduled for creation every 30 pitches may be created every 15 pitches in response to a fault detection signal. The relatively infrequent schedule of every 30 pitches is effected only if the needs of the black process station are being met. In the event that its needs are not being met, the frequency of the black patch creation is increased to every 15 pitches by means of an adaptive patch scheduling algorithm contained in the MIOP. The frequency of patch generation of the other image process stations are also scheduled according to whether their respective process stations are operating satisfactorily. When a process system is working properly there is no need to increase the frequency of its patch schedule. Thus, the control strategy of the present invention provides for varying the frequency of patches on an as needed basis.

Proper cleaning or toner removal of the toner forming the toned control patches requires, for example, two passes (i.e. 30 pitches) of the photoreceptor belt through the xerographic processing stations. Thus, in order to accommodate the creation of a particular color toner patch on a more frequent basis, patch areas normally designated for use by another color toner are utilized for a system exhibiting a problem that must be addressed. This is possible when, for example, one image processing system is exhibiting problems while the other systems are not. In other words, if the black processing station is experiencing difficulties while the other stations are not, then the patch areas normally used for the other toner colors can be utilized for creating additional black patches resulting in an increased rate of black patch generation.

While FIG. 1 shows an example of a digital imaging system utilizing five different color toners and which minimizes toner waste while providing high quality image color creation the invention could be used in an imaging system having more or less developer structures than disclosed herein.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. In a color image creation machine, adaptive control patch scheduling for implementing diagnostics for a xerographic processor's systems parameters and system fault conditions in a manner that minimizes the waste of toner materials without compromising image quality, including the steps of:

using at least one of a plurality of developer structures, forming, at a first frequency, a number of control patches on a charge retentive surface corresponding to the condition of said xerographic processor's systems; forming a number of control patches on said charge retentive surface for monitoring system fault conditions;

sensing said control patches for monitoring said system fault conditions and generating output signals representative of system fault conditions;

comparing said output signals to target values for determining the presence of at least one system fault condition;

generating additional output signals based on the comparison of said output signals to said target values when a system fault condition is sensed; and in response to a system fault condition being sensed, creating toner systems parameters control patches at a frequency greater than said first frequency.

2. Adaptive control patch scheduling according to claim 1 wherein said step of forming control patches for monitoring system fault conditions is effected using at least two complementary color toners.

3. Adaptive control patch scheduling according to claim 2 wherein said step of forming control patches for monitoring system fault conditions is effected using at least two of said plurality of developer structures.

4. Adaptive control patch scheduling according to claim 3 wherein said step of forming control patches corresponding to the condition of said xerographic processor's systems is effected using only one color toner.

5. Adaptive control patch scheduling according to claim 4 wherein all of said patches are formed in an interpage zone on said charge retentive surface.

6. Adaptive control patch scheduling according to claim 5 wherein said charge retentive surface comprises a photoreceptor.

7. Adaptive control patch scheduling according to claim 5 wherein some of said patches are formed in an area of said charge retentive surface normally utilized for toner images.

8. Adaptive control patch scheduling according to claim 7 wherein said charge retentive surface comprises a photoreceptor.

9. Adaptive control patch scheduling according to claim 8 wherein said step of forming control patches for monitoring fault conditions creates at least two patches each using complementary color toners.

10. In a color image creation machine having means for forming toner images including a charge retentive surface, charging devices, image exposure structures and developer structures, the improvement comprising an adaptive patch scheduler for implementing diagnostics for a xerographic processor's systems parameters and system fault conditions in a manner that minimizes the waste of toner materials without compromising image quality:

means for forming, at a first frequency, a number of control patches on a charge retentive surface corresponding to the condition of said xerographic processor's systems;

means for forming a number of control patches on said charge retentive surface for monitoring system fault conditions;

means for sensing said control patches for monitoring said system fault conditions and generating output signals representative of system conditions fault;

means for comparing said output signals to target values for determining the presence of at least one system fault condition;

means for generating additional output signals based on the comparison of said output signals to said target values when a system fault condition is sensed; and means responsive to a system fault condition being sensed for creating toner systems parameters control patches at a frequency greater than said first frequency.

11. The adaptive patch scheduler according to claim 10 wherein said means for forming control patches for monitoring system fault conditions is effected using at least two different color toners.

12. The adaptive patch scheduler according to claim 11 wherein said means for forming control patches for monitoring system fault conditions is effected using at least two of said plurality of developer structures.

13. The adaptive patch scheduler according to claim 12 wherein said means for forming control patches corresponding to the condition of said xerographic processor's systems is effected using only one color toner.

14. The adaptive patch scheduler according to claim 13 wherein all of said patches are formed in an interpage zone on said charge retentive surface.

15. The adaptive patch scheduler according to claim 14, wherein said charge retentive surface is a photoreceptor.

16. The adaptive patch scheduler according to claim 13 wherein some of said patches are formed in an area of said charge retentive surface normally utilized for toner images.

17. The adaptive patch scheduler according to claim 16 wherein said charge retentive surface is a photoreceptor.

18. The adaptive patch scheduler according to claim 17 wherein said means for forming control patches for monitoring fault conditions comprises means for forming at least two patches each using complementary color toners.

* * * * *